US005104337A

United States Patent [19]

Chow et al.

[11] Patent Number: 5,104,337

[45] Date of Patent: Apr. 14, 1992

[54] STRAIN RELIEF DEVICE FOR AN ELECTRICAL CONNECTOR

[75] Inventors: Hsiu-Shen Chow, Pan-Chiao City, Taiwan; Leonard Ellentuch, Wallkill, N.Y.

[73] Assignees: Chian Chyun Enterprise Co. Ltd., Taipei Hsien, Taiwan; Resco, Inc., Newburgh, N.Y.

[21] Appl. No.: 657,913

[22] Filed: Feb. 20, 1991

[51] Int. Cl.[5] ..... H01R 13/58

[52] U.S. Cl. ..... 439/470

[58] Field of Search ..... 439/455, 456, 459, 465, 439/466, 467, 470, 473

[56] References Cited

U.S. PATENT DOCUMENTS

| | | | |
|---|---|---|---|
| Re. 32,760 | 10/1988 | Chandler et al. | 439/455 |
| 2,128,883 | 8/1938 | Burt | 439/665 |
| 4,449,778 | 5/1984 | Lane | 439/465 |
| 4,501,459 | 2/1965 | Chandler et al. | 439/466 |
| 4,619,494 | 10/1986 | Noorily et al. | 439/449 |
| 4,682,836 | 7/1987 | Noorily et al. | 439/466 |
| 4,952,168 | 8/1990 | Schieferly et al. | 439/467 |

FOREIGN PATENT DOCUMENTS

| | | | |
|---|---|---|---|
| 160555 | 5/1933 | Switzerland | 439/465 |

*Primary Examiner*—Gary F. Paumen

*Attorney, Agent, or Firm*—Sprung Horn Kramer & Woods

[57] ABSTRACT

An electrical connector comprises a housing having an opening for an electrical cable and a strain relief device for holding a cable in position in said opening. The strain relief device includes two half sections which may be separated to permit the insertion of a cable and then pressed together to surround an inserted cable. The half sections have cooperating recessed portions which, when the half sections are pressed together with the recessed portions in facing relationship, form an opening therethrough for the cable. At least one of said recessed portions has at least one inwardly directed projection for holding the cable. The strain relief device also includes an element for holding the half sections together when a cable has been inserted in the recessed portions thereof and the half sections have been pressed together.

15 Claims, 2 Drawing Sheets

FIG.1
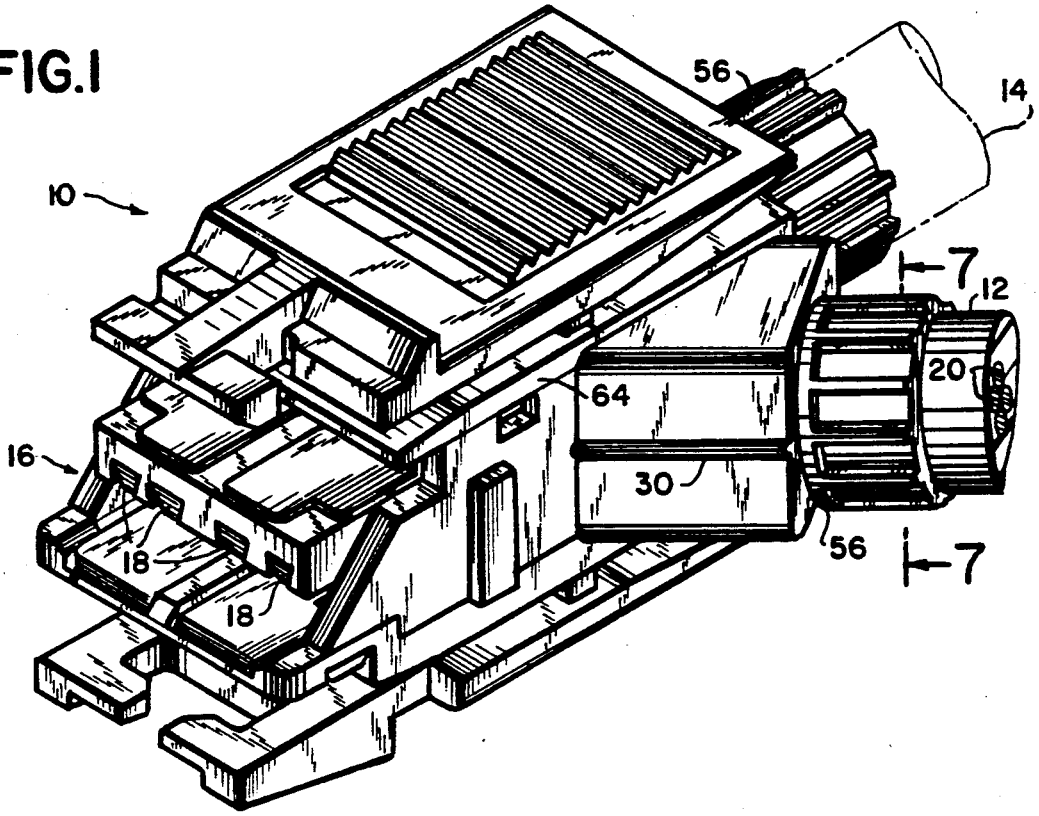
FIG.2
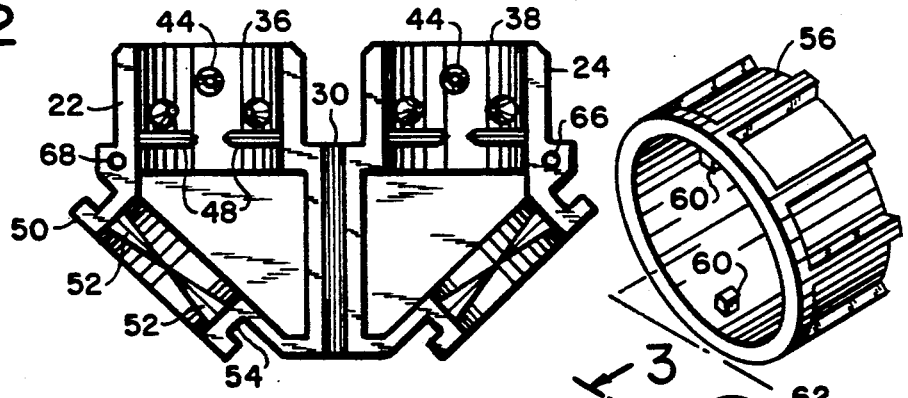
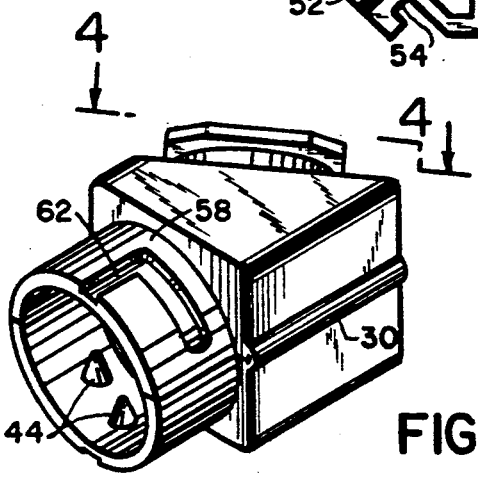
FIG.3
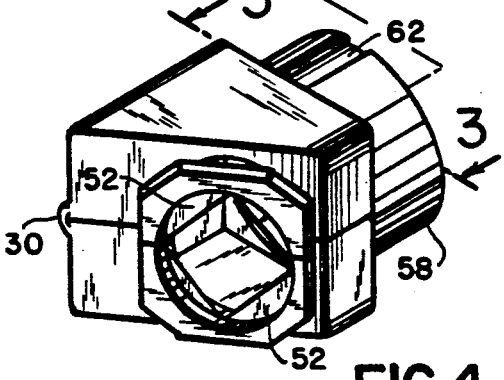
FIG.4

FIG.5
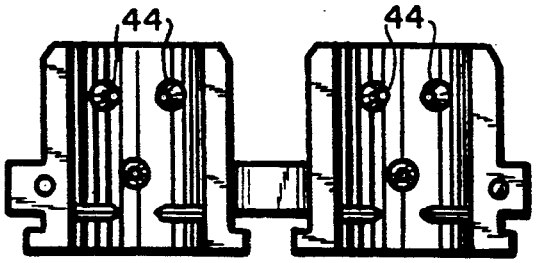
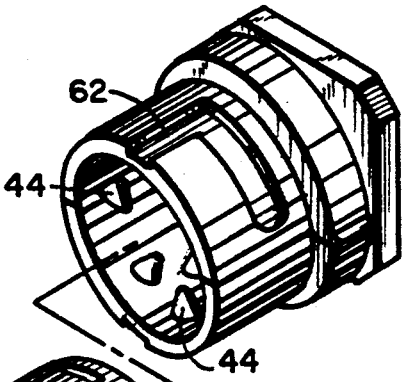
FIG.7
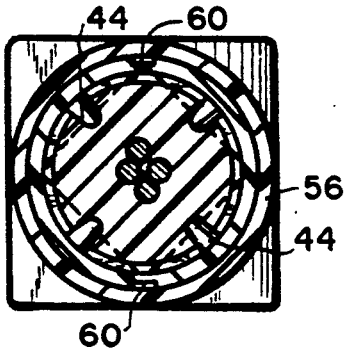
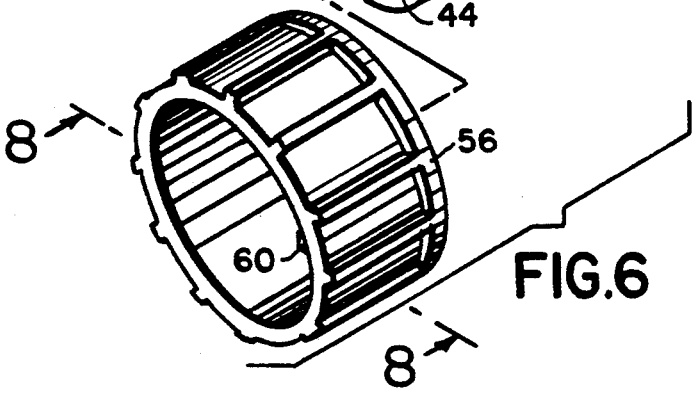
FIG.6
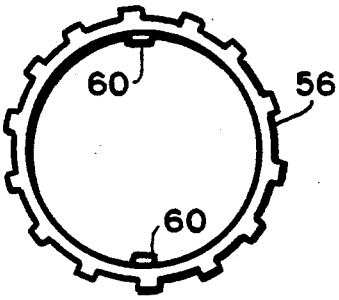
FIG.8
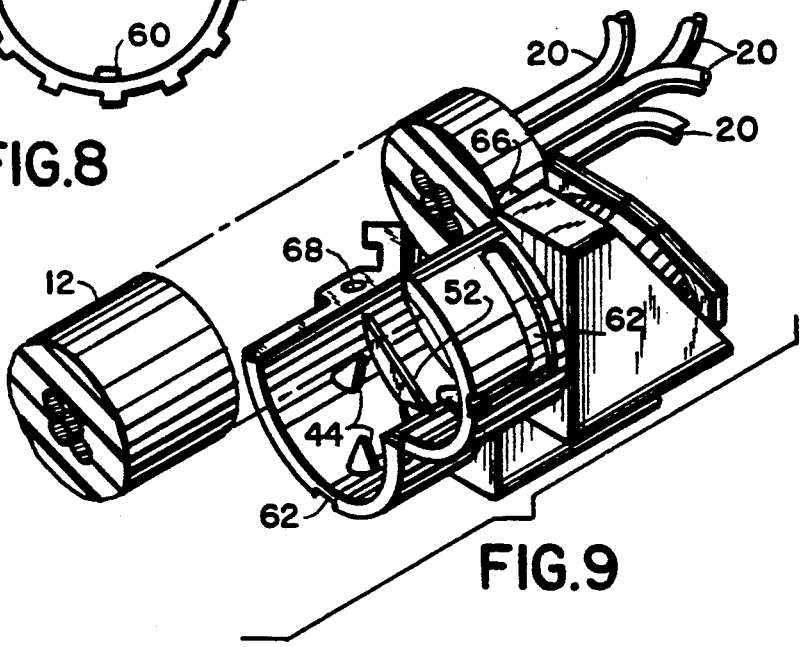
FIG.9

STRAIN RELIEF DEVICE FOR AN ELECTRICAL CONNECTOR

BACKGROUND OF THE INVENTION

The present invention relates to a strain relief device for an electrical connector. More particularly, the invention relates to a strain relief device for holding an electrical cable in position at its point of entry into the connector.

In the use of electrical connectors there is a need to provide a device for holding or clamping an electrical cable at the point of entry into the connector. Various strain relief techniques have been devised for use with electrical connectors in an effort to mechanically secure a cable thereto. One of the concerns, in providing this strain relief, is the ease with which the cable may be attached and detached from the electrical connector. Another concern, which has not been properly addressed and solved, is the requirement for clamping cables of various diameters.

Electrical connectors of the type to which the present invention relates are shown, for example, in the U.S. Pat. No. 4,449,778 and the U.S. Pat. No. 4,501,459 (reissued as U.S Pat. No. Re. 32,760), both of these connectors being of the electrically shielded type for particular use in the data communication industry.

The strain relief device disclosed in these patents requires the terminal end of a cable to be specially configured with a section of widened insulation having a circumferencial groove which fits into a slot in the connector housing.

Other solutions to the strain relief problem are disclosed in the U.S. Pat. Nos. 4,619,494 and 4,682,836. In the electrical connectors disclosed in these patents, the strain relief is effected by providing a metal washer or the like on the terminal end of the cable which is mechanically surrounded by the shielding braid. The cable end, with this washer, is then inserted into a slot in the housing before the housing is closed. Thereafter, the washer, which is larger than the housing opening, prevents removal of the cable.

Both of these prior art solutions to the strain relief problem require that the cable be modified at its terminal end. In addition, these solutions do not accommodate cables of different size.

SUMMARY OF THE INVENTION

It is an object of the present invention to provide an improved strain relief device for an electrical connector which overcomes the disadvantages of the strain relief devices presently known in the art.

This object, as well as other objects which will become apparent from the discussion that follows, are achieved, in accordance with the present invention, by providing a device, adapted to be disposed in the opening of an electrical connector housing, which device includes two half sections that may be separated to permit the insertion of a cable and then pressed together to surround the cable. The half sections have cooperating recessed portions which, when the half sections are pressed together with the recessed portions in facing relationship, form an opening therethrough for the cable. At least one of the recessed portions has at least one inwardly directed projection for holding the cable. The strain relief device also includes an element for holding the half sections together when a cable has been inserted in the recessed portions thereof and the half sections have been pressed together.

Further features and advantages of the present invention will be described hereinbelow.

The preferred embodiments of the present invention will now be described with reference to the accompanying drawings.

BRIEF DESCRIPTION OF THE DRAWINGS

FIG. 1 is a perspective view of an hermaphroditic connector having two strain relief devices of the type to which the present invention relates.

FIG. 2 is a top view of a strain relief device for the connector of FIG. 1 which has been opened to permit the insertion of a cable.

FIG. 3 is a perspective view showing one side of the strain relief device of FIG. 2.

FIG. 4 is a perspective view showing another side of the strain relief device of FIG. 2.

FIG. 5 is a top view of another strain relief device for use with the connector of FIG. 1, which device has been opened to permit insertion of a cable.

FIG. 6 is a perspective view of the strain relief device of FIG. 5, with an associated nut for holding it together.

FIG. 7 is an end view of the strain relief devices of FIGS. 2–6.

FIG. 8 is an end view of the nut shown in FIG. 6.

FIG. 9 is a perspective view showing the insertion of a cable in the strain relief device of FIGS. 2–4.

DESCRIPTION OF THE PREFERRED EMBODIMENTS

The preferred embodiments of the present invention will now be described with reference to FIGS. 1–9 of the drawings. Identical elements in the various figures are identified with the same reference numerals.

FIG. 1 shows an electrical connector of the type to which the present invention relates. This electrical connector 10, which is particularly useful in the data communications industry, is connected to an electrical cable 12 that enters from one side or to a cable 14, shown in phantom view, that enters from one end of the connector. Such an electrical connector is shown and described more fully in the aforementioned U.S. Pat. Nos. 4,449,778 and 4,501,459 (reissued as U.S. Pat. No. Re. 32,760). Suffice it to say, for the purposes of this discussion, that the connector is a hermaphroditic, shielded electrical connector having an open end 16 designed to mate with another, identical electrical connector or with some other device. Four electrical contacts 18 at the mating end of the device are electrically connected with four insulated wires 20 within the shielded cable 12.

FIGS. 2–4 illustrate one preferred embodiment of a strain relief device for use with the connector of FIG. 1. FIGS. 5 and 6 illustrate another preferred embodiment of this strain relief device. Both embodiments according to the invention are light in weight, easy to assemble and disassemble, and accommodate cables of different diameters.

The difference between the embodiments of FIGS. 2–4, on one hand, and FIGS. 5 and 6, on the other, is merely the angle at which the cable is to enter the housing.

As shown in FIGS. 2 and 5, the strain relief device comprises two half sections 22 and 24 (FIG. 2) and 26 and 28 (FIG. 5), made of plastic or other electrically insulating material, which are joined by a plastic web hinge 30 and 32, respectively. The half sections are separable to permit the insertion of a cable and may be pressed together to surround an inserted cable in the manner illustrated in FIG. 9. The half sections have cooperating recessed portions 36 and 38 (FIG. 2) and 40 and 42 (FIG. 5) which, when the half sections are pressed together with the recessed portions in facing relationship, form an opening therethrough for the cable.

On the surfaces of the recessed portions are disposed a plurality of inwardly directed projections for holding the cable. In the embodiments shown these projections include three cone shaped projections 44, arranged at the corners of a substantially equilateral triangle, and two bar-shaped projections 48 arranged on a common circumferencial line or circle. The inwardly directed projections on one half section are arranged diametrically opposite to the inwardly directed projections of the other half section when the two half sections are pressed together.

Similarly, as shown in FIGS. 2–4, a flanged portion 50 configured to retain the two half sections in the housing 10, are provided with internal bar-shaped projections 52 forming a square "window" for entry of the cable. Immediately adjacent to the flange 50 is disposed a groove 54 for receiving the edge of the opening in the housing 30.

In order to retain the two half sections together when a cable has been inserted in the recessed portions thereof and the half sections have been pressed together, there is provided a substantially cylindrical nut 56 configured to surround the cylindrical end portion 58 of the two half sections. The nut includes a substantially cylindrical internal surface and two inwardly directed lugs 60 disposed on this internal surface. Each lug is designed to engage in an L-shaped groove 62 on one of the half sections.

When the cable is to be inserted into the connector housing 10, the strain relief device comprising the two half sections is opened and clamped around the end of the cable as shown in FIG. 9. Thereafter, a nut 56, which has previously been placed over the end of the cable, is drawn over the end 58 of the strain relief device and rotated clockwise to lock it in place. The application of the nut insures that the projections 44 and 48 have been pressed firmly against the cable when the half sections are pressed together, and prevents the half sections from subsequently opening and losing their grip on the cable. Thereafter, the entire strain relief unit with the two half sections and the nut are inserted in a opening or slot in the housing. Finally, the top panel 64 of the housing is placed thereon and snapped into place.

The projections 44 and 48 are so designed that they will pierce and hold the surface of a cable, provided that the cable is within a prescribed range of diameters.

If desired, the inner surface of the nut can be tapered so as to apply increasing pressure to the two half sections when the nut is placed over the cylindrical end 58.

There has thus been shown and described a novel strain relief device for an electrical connector which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. An electrical connector comprising:

(a) a housing having an opening for an electrical cable; and (b) strain relief means disposed in said opening for holding a cable in position in said opening, said strain relief means including:

(1) two half sections which may be separated to permit the insertion of a cable and then pressed together to surround an inserted cable, said half sections having cooperating recessed portions which, when said half sections are pressed together with said recessed portions in facing relationship, form an opening therethrough for the cable, at least one of said recessed portions having at least one inwardly directed projection for holding the cable; and (2) means for holding said half sections together when a cable has been inserted in the recessed portions thereof and said half sections have been pressed together, said holding means comprising a nut configured to surround an end portion of said two half sections when they are pressed together.

2. The electrical connector defined in claim 1, wherein said two half sections are substantially similar.

3. The electrical connector defined in claim 1, wherein said recessed portions form a cylindrical opening for the cable when the half sections are pressed together.

4. The electrical connector defined in claim 1, wherein said nut includes a substantially cylindrical internal surface and at least one inwardly directed lug disposed on said internal surface, and wherein at least one of said half sections includes a groove for insertion of said lug, whereby the engagement of said lug in said groove serves to retain said nut in position on said end portion.

5. The electrical connector defined in claim 4, wherein said groove extends from inward from the end of said at least one half section in an L-shaped configuration.

6. The electrical connector defined in claim 1, wherein at least one of said projections is substantially cone shaped.

7. The electrical connector defined in claim 1, wherein at least one of said projections is substantially bar shaped.

8. The electrical connector defined in claim 1, wherein each half section has at least one inwardly directed projection.

9. The electrical connector defined in claim 8, wherein each half section has a plurality of inwardly directed projections.

10. The electrical connector defined in claim 9, wherein each half section has three inwardly directed projections, arranged at the corners of a substantially equilateral triangle.

11. The electrical connector defined in claim 9, wherein the inwardly directed projections of one half section are arranged substantially opposite to the inwardly directed projections of the other half section when said half sections are pressed together.

12. The electrical connector defined in claim 1, wherein said half sections are hinged together along adjacent edges.

13. The electrical connector defined in claim 12, wherein said half sections are hinged by a thin web of material.

14. The electrical connector defined in claim 1, wherein said strain relief means further includes means for mechanically engaging said two half sections with said housing in said opening.

15. The electrical connector defined in claim 14, wherein said engaging means includes a flange arranged for insertion in said housing and a groove disposed adjacent said flange for receiving the edge of said opening in said housing.

* * * * *